US007588419B2

(12) United States Patent
Hong et al.

(10) Patent No.: US 7,588,419 B2
(45) Date of Patent: Sep. 15, 2009

(54) VEHICLE COOLING FAN

(75) Inventors: Tao Hong, Farmington Hills, MI (US); John R Savage, Rochester Hills, MI (US)

(73) Assignee: Valeo, Inc., Auburn Hills, MI (US)

( * ) Notice: Subject to any disclaimer, the term of this patent is extended or adjusted under 35 U.S.C. 154(b) by 348 days.

(21) Appl. No.: 11/389,848

(22) Filed: Mar. 27, 2006

(65) Prior Publication Data

US 2007/0224045 A1 Sep. 27, 2007

(51) Int. Cl.
*F04D 29/00* (2006.01)

(52) U.S. Cl. ..... 415/211.2

(58) Field of Classification Search ..... 415/211.2, 415/1; 138/37, 39; 123/41.49
See application file for complete search history.

(56) References Cited

U.S. PATENT DOCUMENTS

| | | | | |
|---|---|---|---|---|
| 2,538,739 | A | 1/1951 | Troller | |
| 2,900,128 | A * | 8/1959 | Piper, Jr. et al | 415/211.2 |
| 4,548,548 | A | 10/1985 | Gray, III | |
| 4,616,557 | A | 10/1986 | Paoluccio | |
| 4,969,421 | A | 11/1990 | Haner et al. | |
| 5,224,447 | A | 7/1993 | Braatz et al. | |
| 5,240,373 | A * | 8/1993 | Mita et al. | 415/211.2 |
| 5,460,485 | A | 10/1995 | Sugiyama et al. | |
| 5,466,120 | A | 11/1995 | Takeuchi et al. | |
| 5,577,888 | A | 11/1996 | Capdevila et al. | |
| 5,590,624 | A * | 1/1997 | Emond et al. | 123/41.49 |
| 6,827,547 | B2 * | 12/2004 | Robb | 415/1 |
| 7,007,403 | B1 | 3/2006 | Studebaker | |

FOREIGN PATENT DOCUMENTS

| | | |
|---|---|---|
| DE | 4105378 | 8/1992 |
| DE | 19948074 | 4/2000 |
| DE | 10041805 | 6/2002 |
| FR | 2784423 | 4/2000 |
| GB | 2344619 | 6/2000 |

* cited by examiner

*Primary Examiner*—Ninh H Nguyen
(74) *Attorney, Agent, or Firm*—Jacox, Meckstroth & Jenkins

(57) ABSTRACT

A cooling fan for a vehicle. Many engine compartments of motor vehicles are small in size, and contain numerous components. Electric cooling fans are used to draw air through a radiator. Given the cramped conditions within the engine compartment, the exhaust of the fan cannot be directed into open air, but must impinge on one or more of the components within the compartment. This situation reduces velocity in the exhaust, and also reduces efficiency of the fan. The invention provides a collection of generally co-axial stators which divert the exhaust around the components, while retaining much of the velocity of the exhaust.

14 Claims, 15 Drawing Sheets

VEHICLE COOLING FAN

BACKGROUND OF THE INVENTION

In modern motor vehicles, the engine compartment is becoming increasingly crowded, primarily because of (1) the placement of additional components into the engine compartment, (2) the reduction in volume of the engine compartment, primarily to reduce overall aerodynamic drag of the vehicle, and many other factors.

The crowded nature of the compartment can cause problems in the operation of a cooling fan, such as that illustrated in FIG. 1. Fan 3 draws air 4 through a heat exchanger 6, commonly termed a radiator, thereby cooling the liquid coolant within the radiator 6. However, if, as on the right side of the Fig., an obstruction 9 is positioned within the exhaust of the fan 3A, the obstruction 9 can reduce flow through the radiator, thereby reducing cooling.

The invention presents a stratagem for reducing the negative effects of the obstruction 9.

SUMMARY OF THE INVENTION

An object of the invention is to provide an improved cooling fan for a vehicle.

A further object of the invention is to provide a cooling fan for a vehicle which operates efficiently in a confined environment.

In one form of the invention, stators are positioned in the exhaust stream of a cooling fan in a motor vehicle. The stators divert air into the radial direction, while increasing total airflow over the situation wherein the exhaust stream impinges on an obstacle it its path.

In one aspect, one embodiment comprises an apparatus, comprising: a cooling fan: draws cooling air through a radiator in a vehicle and expels exhaust air toward an obstacle; and a component positioned in the exhaust which increases efficiency of the fan by a measurable amount during at least some operating conditions of the cooling fan.

In another aspect, one embodiment comprises an apparatus, comprising: a generally axial-flow cooling fan which produces exhaust air in a vehicle; an obstacle present in the exhaust air, which diverts at least some of the exhaust air towards a radial direction, having a velocity above V1 over a distance D1; and means, present in the exhaust, for increasing V1.

In still another aspect, one embodiment comprises an apparatus, comprising: an axial-flow cooling fan in a vehicle comprising an obstruction downstream of the cooling fan which, together with a housing of the fan, forms a nozzle through which fan exhaust passes; and a plurality of stators between the cooling fan and the obstruction which divert fan exhaust into the nozzle, to increase average speed at the nozzle outlet.

In yet another aspect, one embodiment comprises an apparatus, comprising: a cooling fan which requires a torque T1 to produce a flow F1 in the absence of a predetermined downstream obstruction, and that requires a torque T2, higher than T1, to produce the flow F1 in the presence of the downstream obstruction; and means for reducing the required torque below T2, to produce the flow F1 in the presence of the downstream obstruction.

In yet another aspect, this invention comprises an apparatus, comprising: a cooling fan which requires a torque T1 to produce a pressure rise P1 across the fan disc in the absence of a predetermined downstream obstruction, and requires a torque T2, higher than T1, to produce the pressure rise P1 in the presence of the downstream obstruction; and means for reducing the required torque below T2, to produce the pressure rise P1 in the presence of the downstream obstruction.

In still another aspect, one embodiment comprises an apparatus, comprising: a vehicle having an engine compartment; a cooling fan within the engine compartment which blows air in an axial direction; and stator vanes which divert part of the air into a radial direction, but do not divert another component of the airflow.

In yet another aspect, one embodiment comprises an apparatus, comprising: a vehicle powered by a heat-producing engine; a fan having an axis and which cools an upstream heat exchanger which cools coolant used by the engine, and produces an exhaust stream; an obstacle in the exhaust stream which creates an unfavorable angle of attack within the fan; and a diverter means which diverts exhaust around the obstacle, to thereby improve the angle of attack within the fan.

In still another aspect, one embodiment comprises a method of designing a fan which (1) draws air through a heat exchanger in an engine compartment of a vehicle and (2) produces an exhaust stream which impinges on an obstacle which interferes with optimal operation of the fan, comprising: measuring, computing, or estimating first fan operating characteristics when a first set of vanes is present between the fan and the obstacle; and measuring, computing, or estimating second fan operating characteristics when a second set of vanes, different from the first set, is present between the fan and the obstacle.

In yet another aspect, one embodiment comprises an apparatus, comprising: a vehicle having an engine compartment; a fan which draws air through a heat exchanger which cools engine coolant; an obstruction downstream of the fan; and a means for reducing pressure loss of fan exhaust due to the obstruction.

In still another aspect, one embodiment comprises an apparatus, comprising: a vehicle having an engine compartment; a fan which draws air through a heat exchanger which cools engine coolant; an obstruction downstream of the fan; and a means for reducing disruption in streamlines within the fan caused by the obstruction.

These and other objects and advantages of the invention will be apparent from the following description, the accompanying drawings and the appended claims.

DETAILED DESCRIPTION OF THE INVENTION

Figure 2:
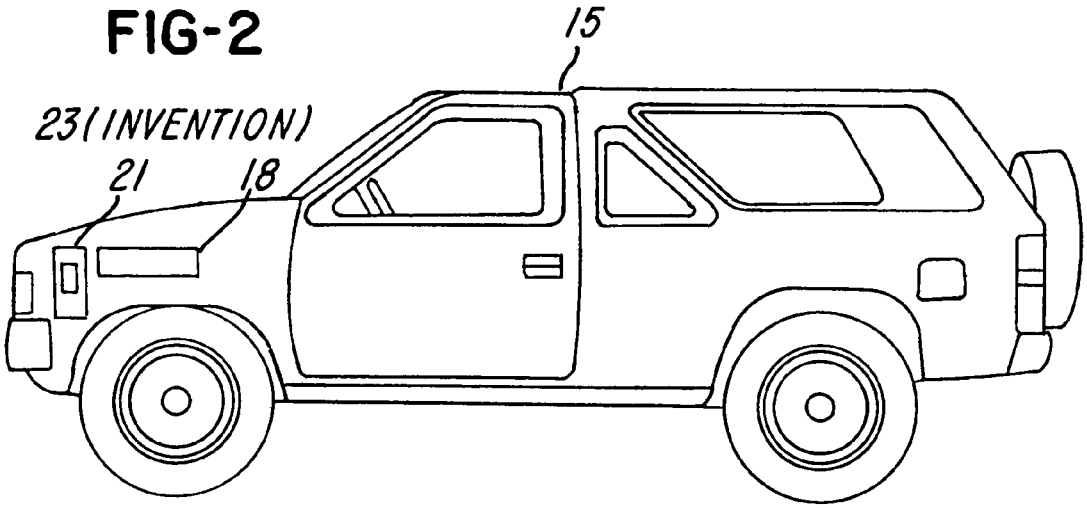
FIG. 2 illustrates the general location of the invention within the vehicle environment.
Figure 1:
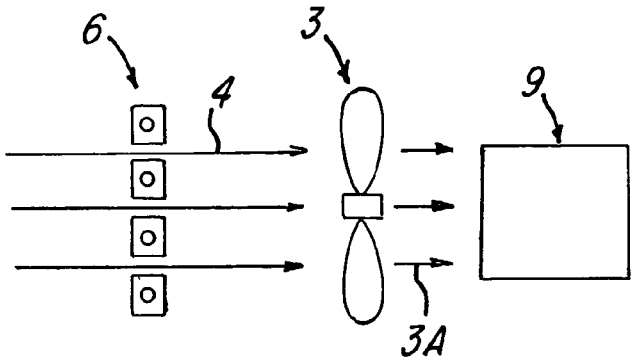
FIG. 1 illustrates a prior-art fan used to cool a component in a vehicle.

FIG. 2 illustrates a generalized motor vehicle 15, which contains an element 18, such as a gasoline engine, which requires cooling. Block 21 represents a cooling system, which is shown in greater detail in FIG. 3.

Figure 3:
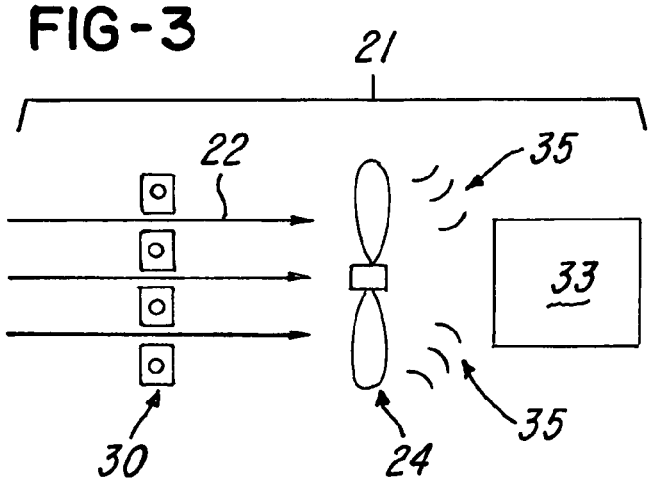
FIG. 3 illustrates a fan used in FIG. 2.

In FIG. 3, a fan 24, which is preferably, but not limited, to being driven by an electric motor (not shown), and preferably runs at a relatively constant speed, draws airstreams 22 through a radiator 30. An obstruction 33 can be present in the exhaust of the fan 24. The invention utilizes stators 35 to divert air around the obstruction 33.

Figure 4:
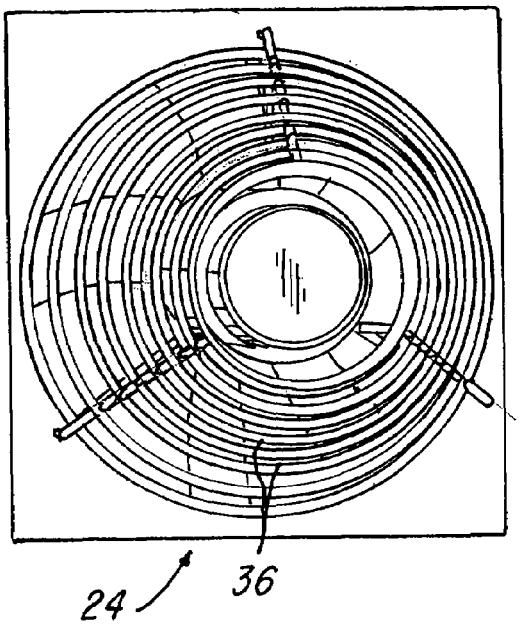
FIGS. 4 and 5 illustrate one form of the invention.
Figure 5:
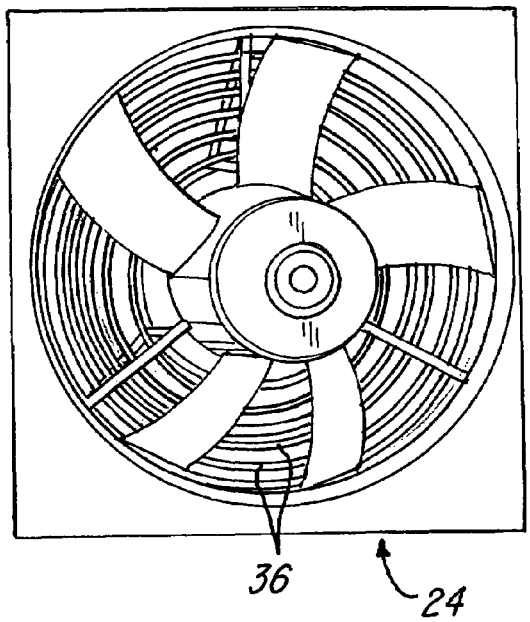
Figure 6:
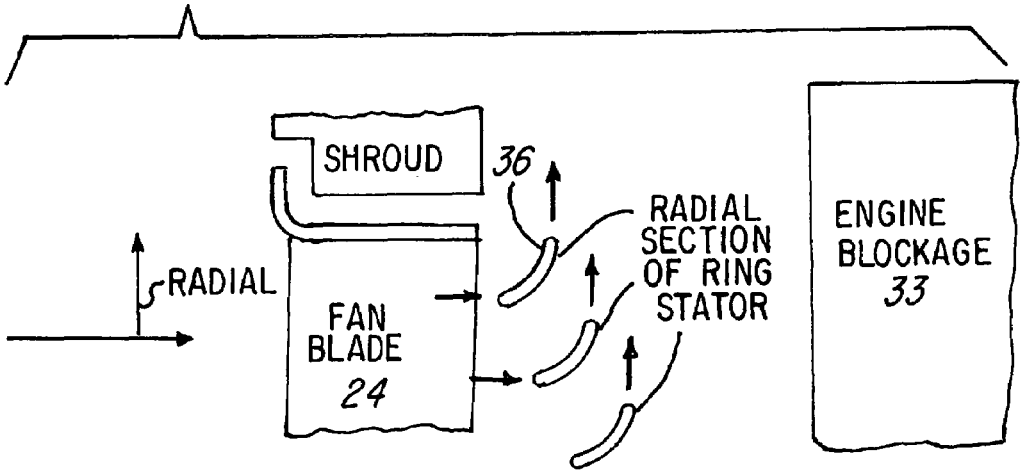
FIG. 6 is a cross-sectional view of part of FIG. 4 or 5.
Figure 7:
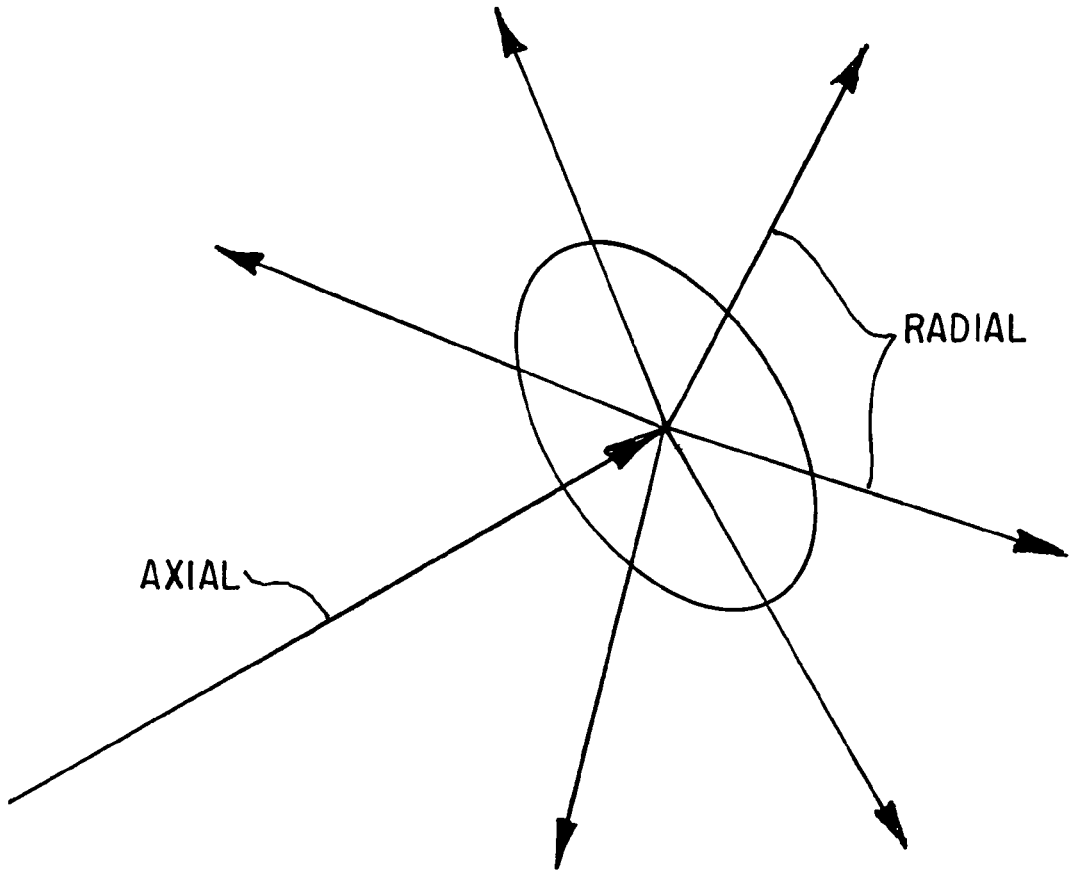
FIG. 7 is a three-dimensional view of turning of air, which occurs in FIG. 6.

FIGS. 4 and 5 illustrate one type of fan 24 that can be used. Stators 36 are present in the exhaust of the fan 24 and function to turn the axial component and increase the radial component of the fan exhaust, as indicated in FIG. 6. It is emphasized that FIG. 6 is a fragmentary cross-sectional view; FIG. 7 illustrates the turning accomplished by the stators 36 in perspective view.

Figure 8:
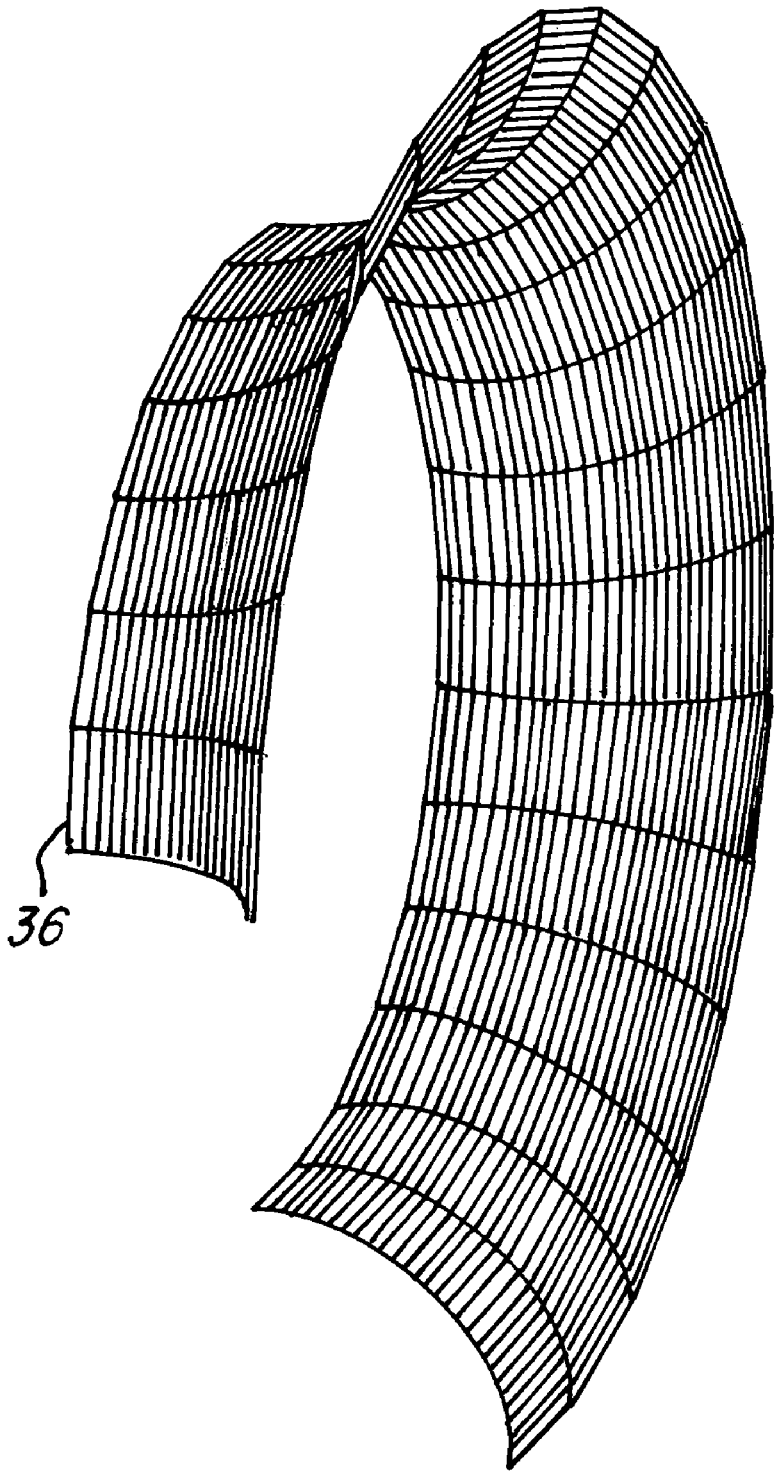
FIG. 8 illustrates one of the stators of FIGS. 4 and 5, in perspective view.

FIG. 8 illustrates a perspective view showing a cutaway drawn in wire frame illustration which is contained to show a cut away of one of the stators 36, but in exaggerated scale: the solid metal/plastic cross section is enlarged with respect to the diameter, to more clearly show the shape of the cross section.

As FIG. 6 indicates, the stators 36 can take the form of circular arcs, spanning 90 degrees, for example.

FIGS. 9-15 set forth test results and simulation results which illustrate selected properties of an embodiment of the invention. FIGS. 9-12 are tracings of digital computer maps produced by simulation software, and are thus approximate illustrations.

Figure 9:
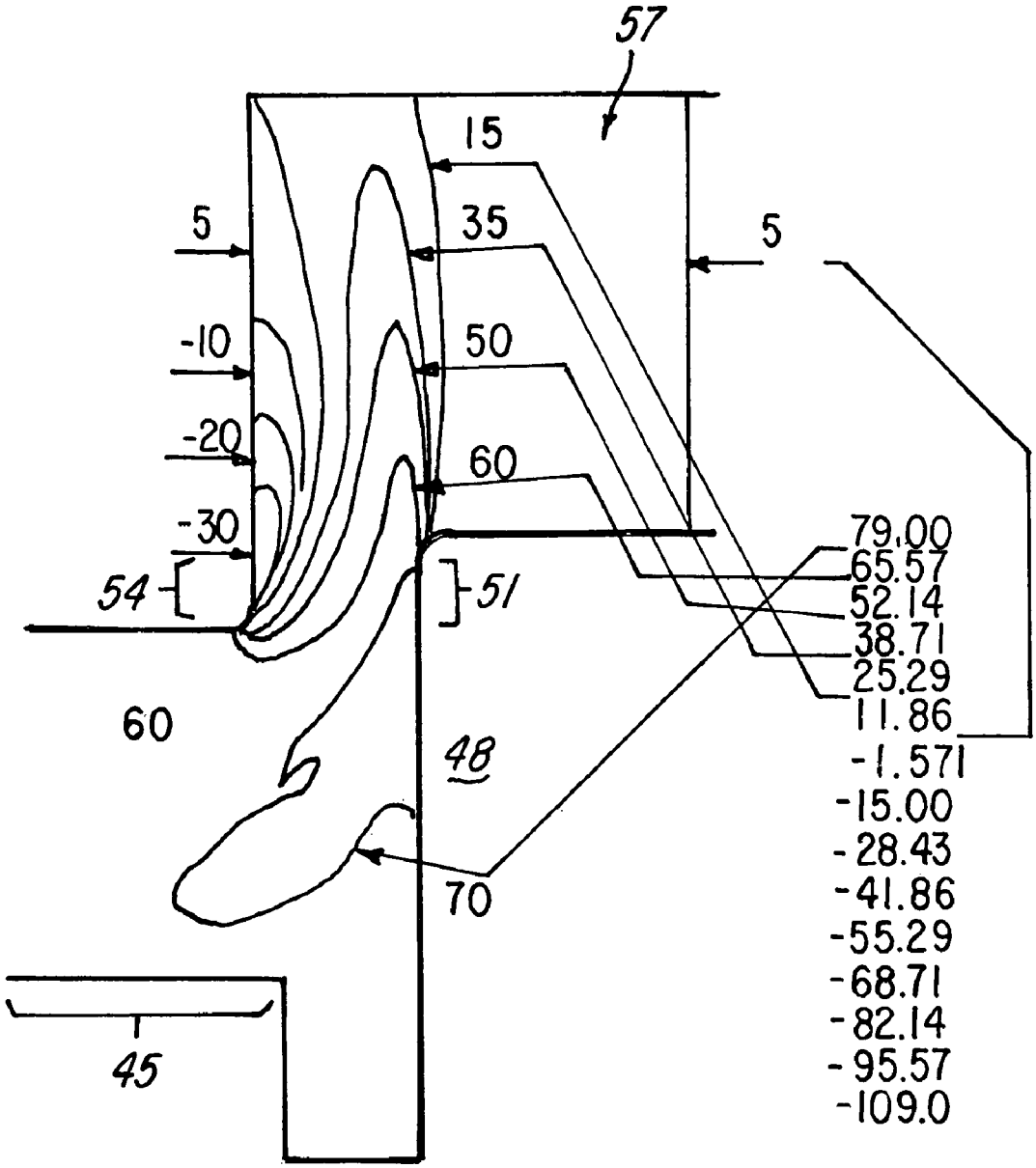
FIGS. 9-12 are plots of velocities and pressure contours that illustrate effectiveness of the stator vanes of FIGS. 4 and 5.
Figure 10:
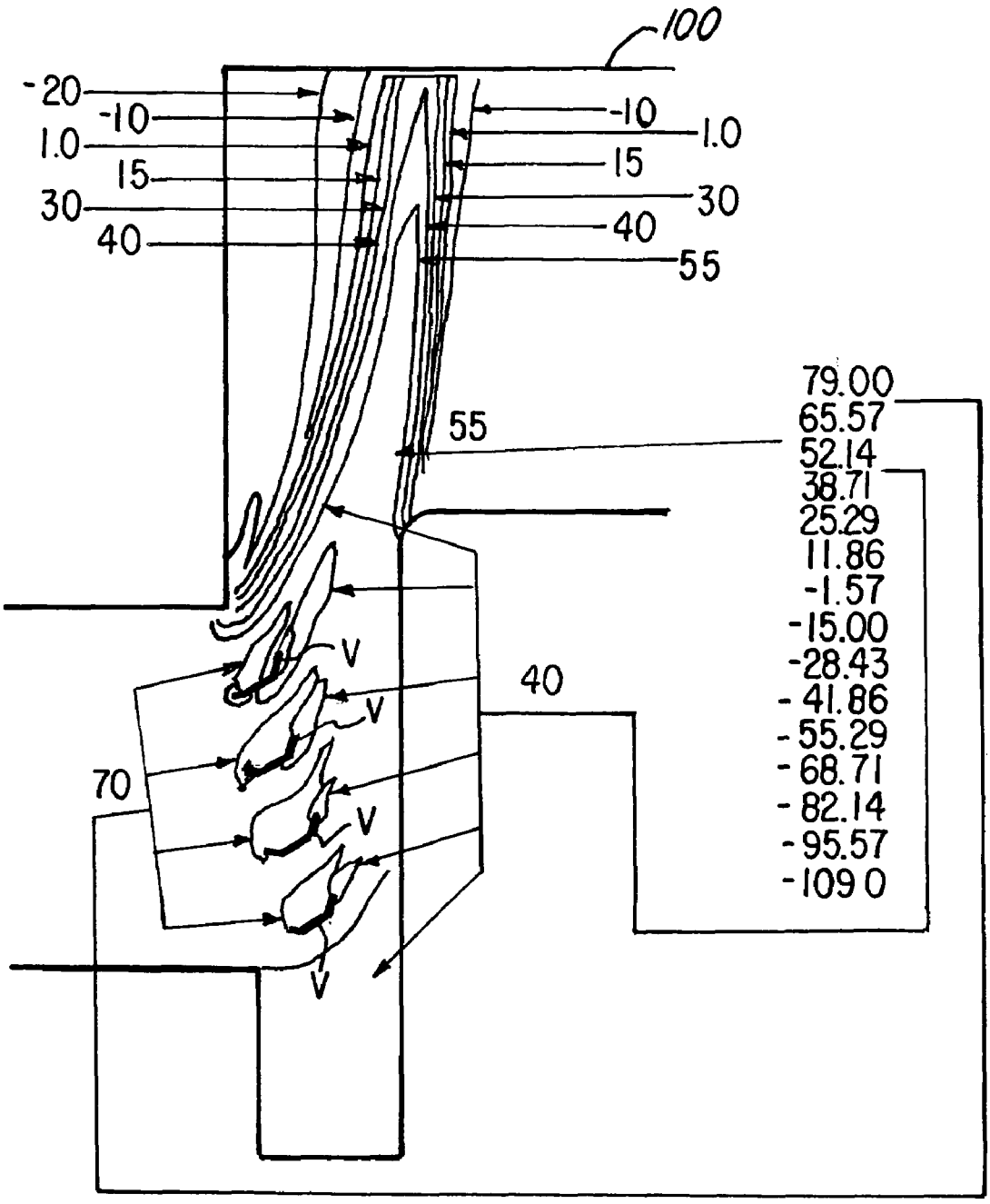

FIGS. 9 and 10 illustrate a cross section of the annular operating region of the fan blade 45, showing the exit plane of the fan blades themselves and an obstruction 48 which is downstream of the annular fan blade region. Wall section 51 of the obstruction 48 can be viewed as cooperating with wall section 54, to thereby form a radial exit flow path for the fan exhaust flow.

FIG. 9 illustrates profiles of total pressure within the system in relative units. Total pressure includes a static component and a dynamic component. A scale of relative pressures is shown as the column of numbers, with 79.00 at the top.

To aid in showing overall patterns, the arrows leading from the scale of relative pressures are labeled with round numbers, such as 1, 15, 35, and so on. These round numbers represent convenient approximate values. For example, the arrow labeled 60 originates at a point between 52.14 and 65.57 on the scale. The number 60 is a convenient intermediate value between those two numbers.

Two significant features of FIG. 9 are that (1) the highest pressure region (labeled 70) abuts the obstruction, and (2) the pressures diminish in the radial direction, as the sequence 60, 50, 35, and 15 indicates.

FIG. 10 is a plot similar to FIG. 9, but with the stator vanes V present. The highest pressure regions (labeled 70) lie on the concave sides of the vanes V.

Significantly, in FIG. 10, the region of next-highest pressure, that labeled 55, extends significantly farther outward in the radial direction than the corresponding region in FIG. 9, and the third pressure region, that labeled 40, extends virtually to the outer boundary 100.

Stated more precisely, FIG. 9 indicates that at the radially outermost point from the flow regime, pressure has dropped from about 70 to about 15 in positive units, or to about 20 percent of the maximal value of 70. In contrast, FIG. 10 indicates that the analogous pressure drop is to only about 40 units, which is about 60 percent of the maximal value.

Thus, under the invention, high total pressure is sustained for a longer radial distance from the fan tip diameter, compared with the case of FIG. 9.

Figure 11:
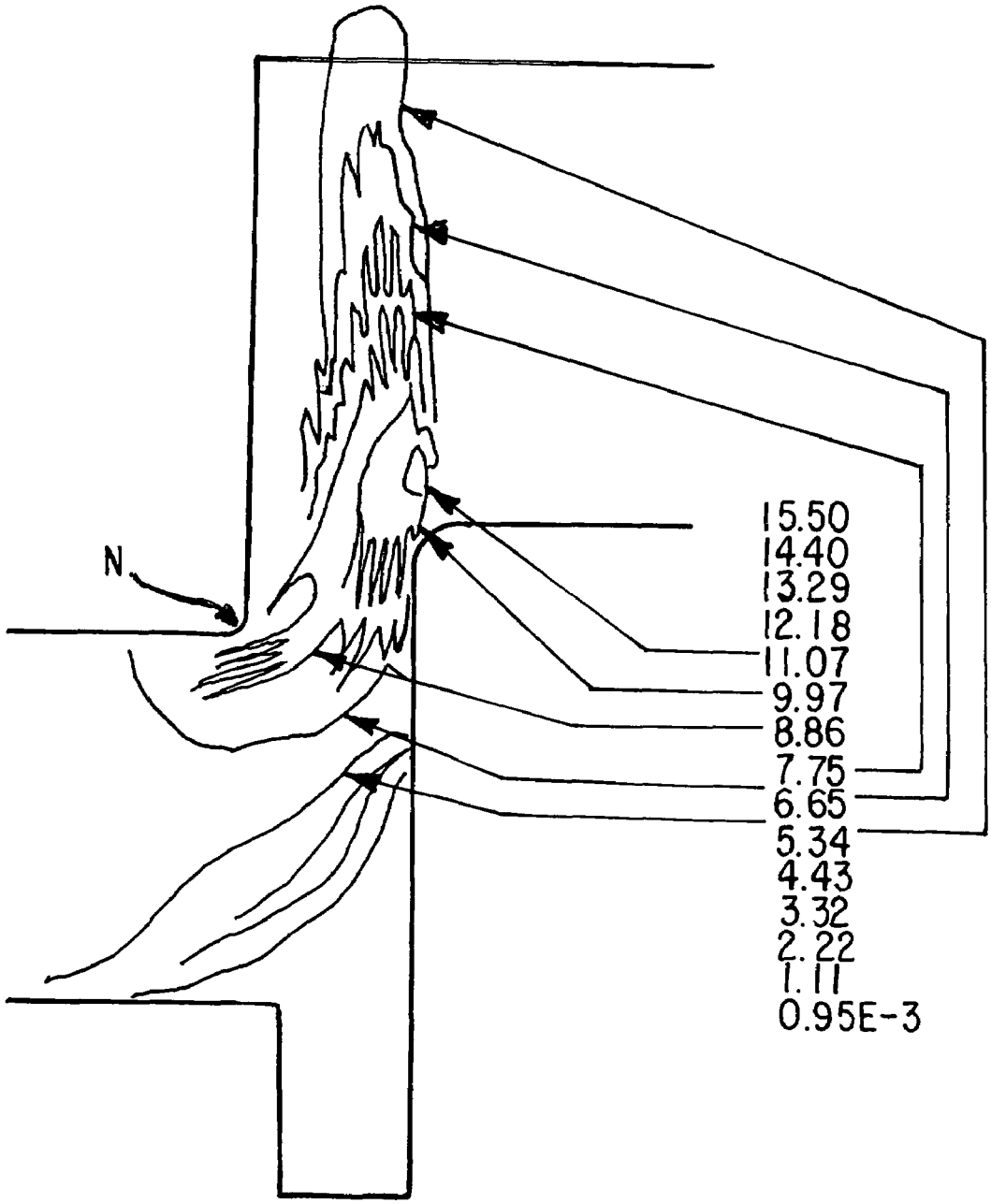
Figure 12:
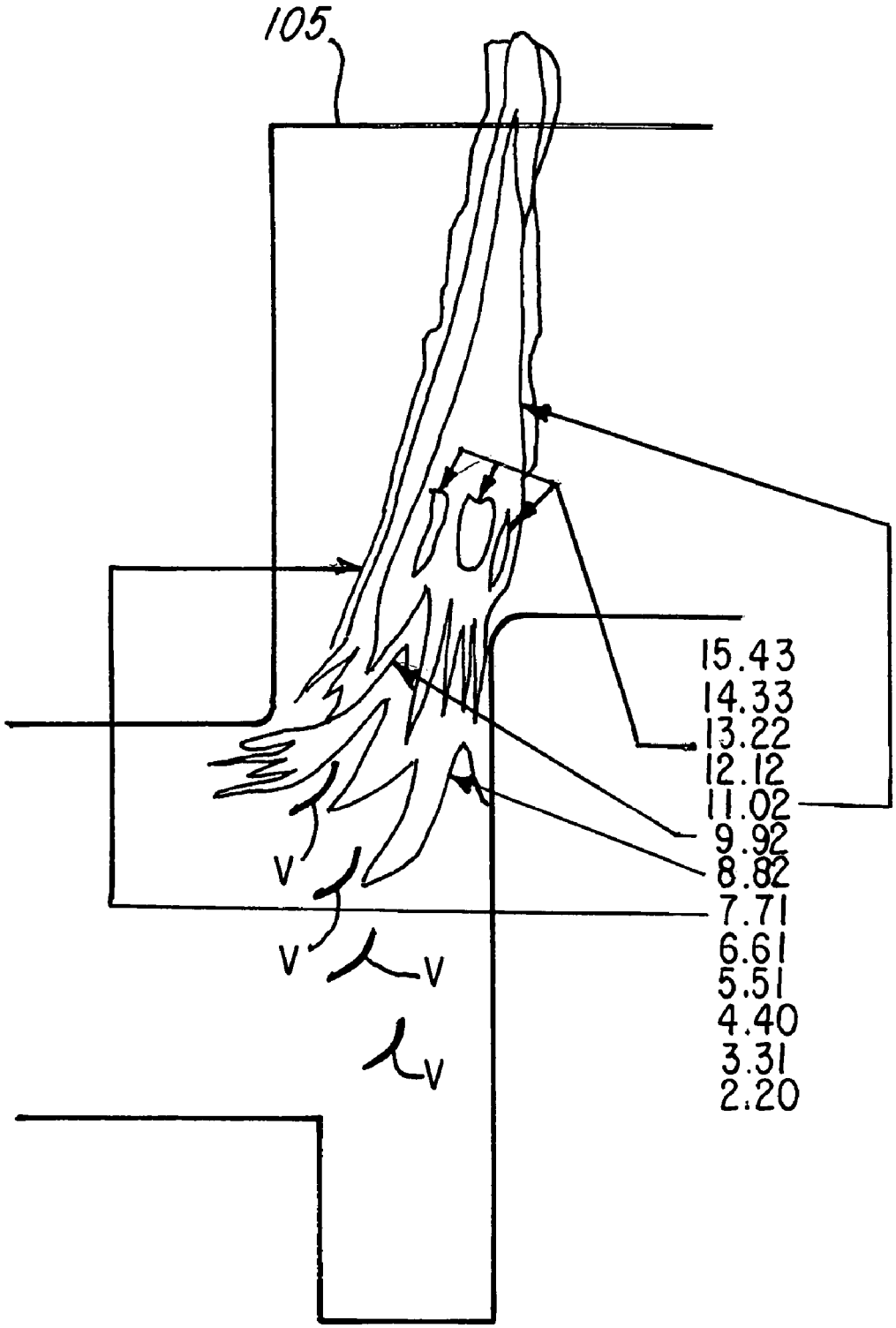

FIGS. 11 and 12 are similar to FIGS. 9 and 10, but illustrate velocity maps. In FIG. 11, the highest velocity is just above 11.07 units, and drops to just above 5.34 units at the radially farthest point from the fan tip diameter region N.

In FIG. 12, in which the stator vanes V are present, the highest velocity is higher, at above 12.12 units, compared with FIG. 11. Further, the triangular region in FIG. 12 labeled with a value of about 11.02, and extending to the radially outermost flow region 105, has a value about equal to the highest velocity in FIG. 11.

That is, the highest velocity in FIG. 11 has a certain value, but which drops to about half that value at the radially outermost flow region 105. In contrast, the vanes in FIG. 12 produce a higher velocity, at roughly the same location, and at least 80 percent of that velocity (about 11.02/12.12) is sustained at the region 105.

The invention of FIG. 12 delivers a higher velocity air stream, such as that indicated as about 11.02 relative units in FIG. 12, for a longer radial distance than does the apparatus of FIG. 11, as a comparison of the region labeled 9.97 in FIG. 11 with that labeled 11.02 in FIG. 12 indicates.

Figure 14:
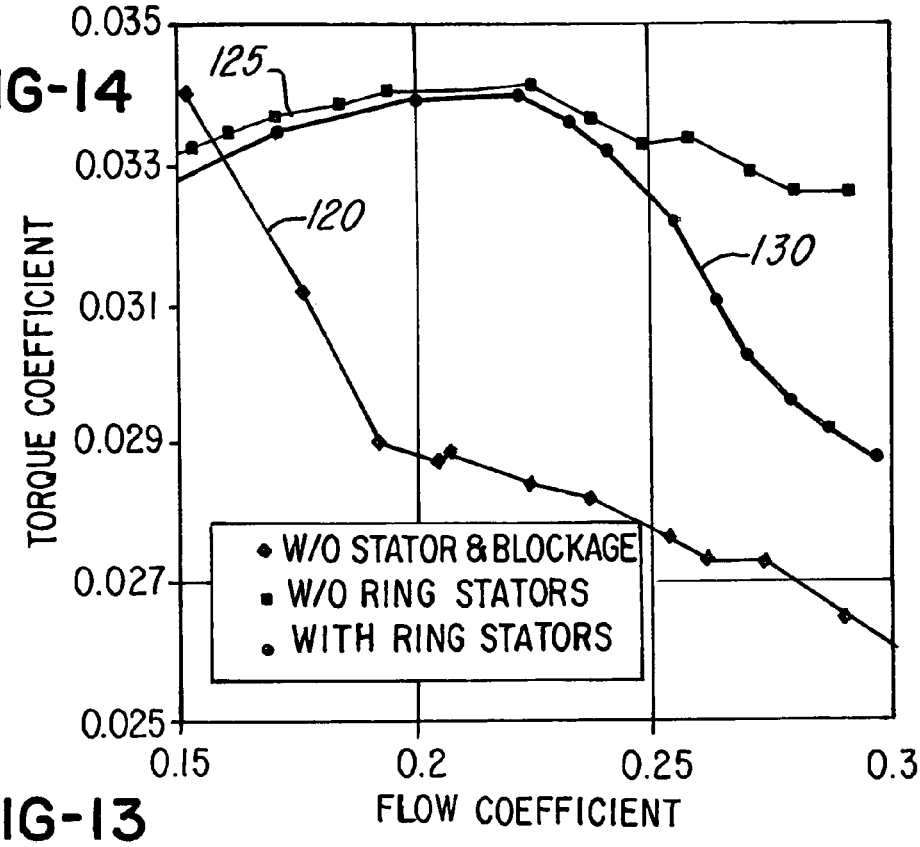
FIGS. 13-15 illustrate flow vs pressure, flow vs input torque, and efficiency of the invention.
Figure 13:
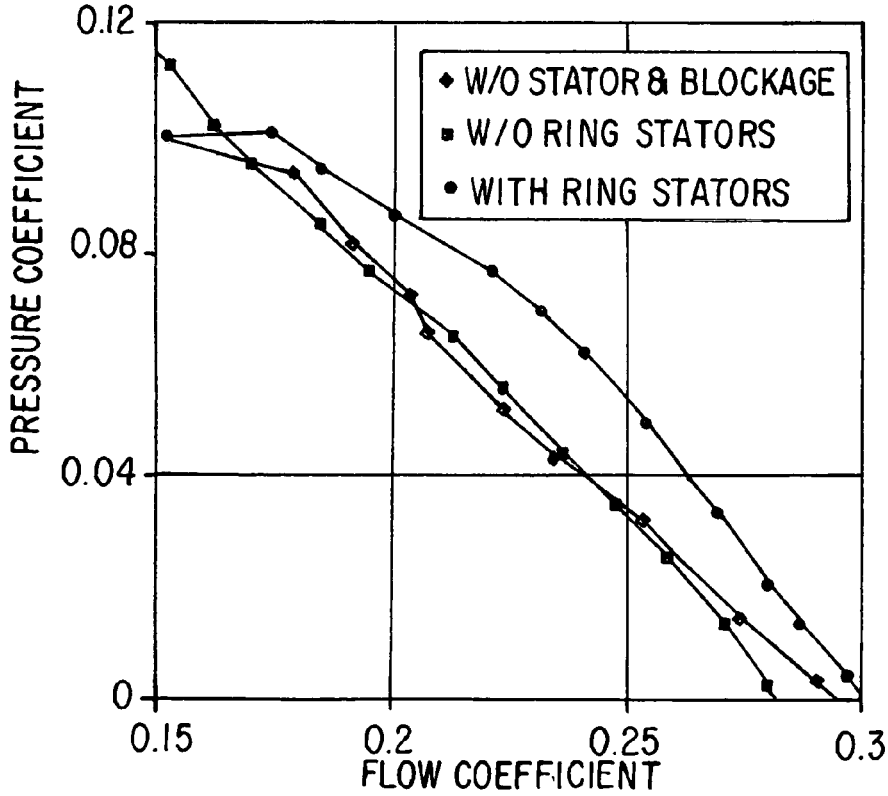
Figure 15:
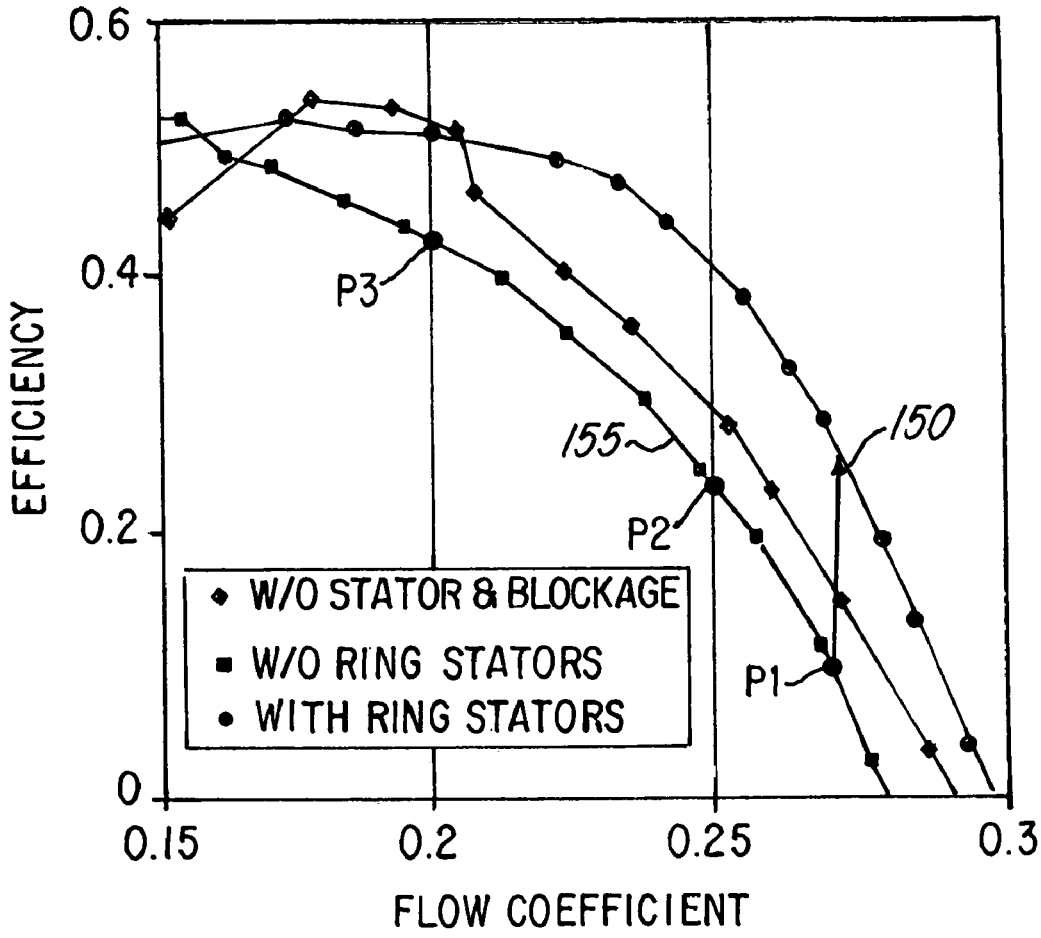

FIGS. 13-15 provide additional test results. Three cases were considered in each plot, namely (1) a physical situation similar to that of FIGS. 9-12, but with no stators present, and no obstruction present (that is, with both stators and downstream blockage absent), (2) a similar physical situation, but with no stators present, but with the obstruction present (that is, with the ring stator absent), and (3) a similar physical situation, but with stators present and the obstruction present (that is, with the ring stators present).

FIG. 13 is a plot of non-dimensional pressure rise coefficient against non dimensional flow coefficient. The pressure coefficient is the ratio of fan static pressure rise divided by both fan RPM and Tip diameter squared. The Flow coefficient is the ratio of the airflow divided by both the speed and fan tip diameter. These coefficients convenient non-dimensional groupings that relate directly to measured static pressure rise and airflow performance.

These convenient non-dimensional groupings allow plots of different experimental setups to be compared directly. For example, if a different fan speed were used or a fan of a different diameter, the plots of those two situations could be compared directly with that of FIG. 13.

FIG. 13 shows that in all cases for a flow rate exceeding about 0.16, the invention provides a higher pressure rise. This pressure rise is a figure-of-merit for the type of fan in question, and the increase in pressure rise indicates better performance, particularly in view of the reduction in torque required to obtain that increase in pressure rise comparing the without vs with ring stator condition for operation above 0.225 flow coefficient.

The pressure rise drops as flow increases because, as flow increases, the dynamic component of the total pressure becomes larger. Because the Fig. reports static pressure, static pressure drops as flow increases.

FIG. 14 is a plot of torque drawn by or applied to the fan 24 by the motor driving the fan 24. Plot 120 indicates that, with no stators nor obstruction present, the torque behavior drops as flow increases.

Plot 125 indicates that, with the obstruction present, but no stators present, torque remains somewhat constant, with a slight rise at about 0.22 units of flow coefficient.

Plot 130 indicates that, with the obstruction present and the stators installed, torque drawn form the motor is about the same as for plot 125, up to about 0.21 units of flow coefficient. Then, torque behavior drops.

FIG. 15 is a plot of efficiency against flow coefficient. FIG. 15 can be derived from FIGS. 13 and 14. From a broad view, FIG. 13 indicates the power produced by the fan. FIG. 14 indicates the power required by the fan. Thus, a comparison of power produced with power required provides a measure of efficiency.

More precisely, efficiency is computed as (P*F)/T wherein

P is the pressure coefficient in FIG. 13,

F is the flow coefficient in FIGS. 13, 14, and 15, and

T is the torque coefficient in FIG. 14.

For example, for a flow coefficient F of 0.2, the pressure coefficient P in FIG. 13 is about 0.075, for the case without both obstruction and stators. The torque coefficient T in FIG. 14 is about 0.029. (P*F)/T equals about (0.075*0.2)/(0.029). Since the quotient 0.075/0.029 is just under 3.0, the answer is under 0.6, consistent with FIG. 15.

FIG. 15 indicates that efficiency of the configuration with both blockage and ring stators increases for all flow coefficients exceeding 0.16. Further, the amount of the increase is obtained from plots 150 and 155. The increase at point P1 is from about 0.1 to 0.3, or by about 300 percent. The increase at point P2 is from about 0.25 to 0.4, or by about 160 percent. The increase at point P3 is from about 0.42 to about 0.52, or about 125 percent.

A significant comparison can be made between curves 155 and 150. The condition without both stators and blockage is a curve of interest, but does not relate to an installed vehicle condition. Curve 150 shows higher efficiency than curve 155 for flow coefficient levels above 0.16. Typical on vehicle operating range for cooling fans of this type ranges from 0.16 at an idle condition to above 0.30 at higher vehicle speed operation. The combination of stators with the downstream blockage provides benefit throughout the entire on vehicle operating range In one mode of operation, it is contemplated that the fan 24 operate above a flow coefficient of 0.25 at least 90 percent of the time.

Additional Considerations

Figure 16:
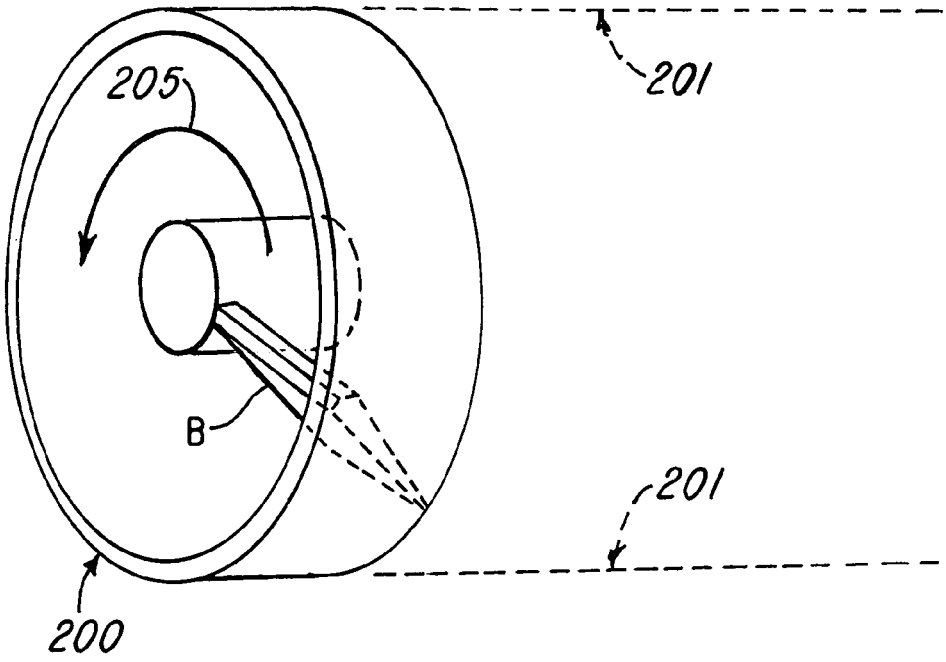
FIG. 16 is a schematic of a blade B of a fan 200.

1. The invention improves efficiency of the cooling system. FIG. 16 illustrates a generalized fan 200 which produces an exhaust stream 201. A single blade B is shown, which rotates in direction 205.

Figure 17:
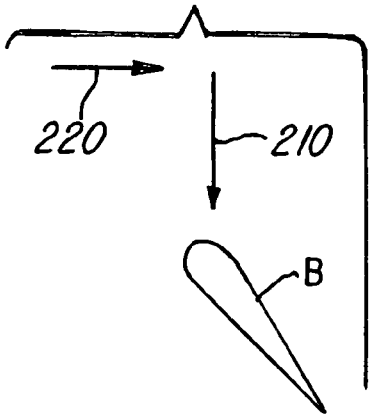
FIG. 17 is a vector diagram illustrating two airstreams 210 and 220 seen by blade B of FIG. 16.

FIG. 17 is a cross section of blade B. Arrow 210 represents the incoming air velocity seen by the blade B, due to rotation alone. The action of the fan 200 itself induces an axial component of inlet flow velocity represented by arrow 220. The magnitude of arrow 220 with respect to arrow 210 will increase with increasing vehicle speed which by the action of higher levels of ram flow admitted by the fan 200.

Figure 18:
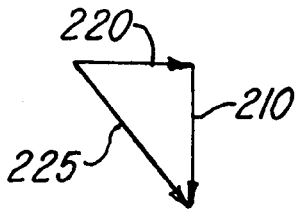
FIG. 18 illustrates the vector sum 225 of the vectors in FIG. 17.

The net incoming air seen by the blade B is the vector sum of the two components 210 and 220, indicated in FIG. 18. In general, for (1) a given rotational speed, which determines vector 210, and (2) a given vehicle speed, which determines vector 220, one (or more) specific blade shapes provide optimal efficiency of the fan 200.

Figure 19:
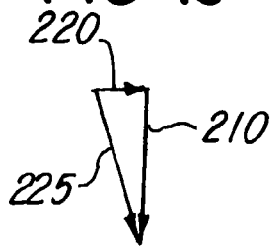
FIG. 19 illustrates how the vector sum 225 changes if the vector 220 changes.

However, the presence of the obstacle disrupts this optimal efficiency. While the particular mechanism of the disruption is complex, a simplified view is that the obstacle reduces the velocity of the air flowing through the fan 200. The disruption can be viewed as reducing the size of vector 220, as indicated in FIG. 19. The vector sum 225 is now different. The changes to the vector sum 225 can vary greatly depending on the location along the blade hub to tip span and the location and nature of the downstream obstacle.

In general, the fan 200 was not designed for this different vector 225, and efficiency is reduced.

Figure 20:
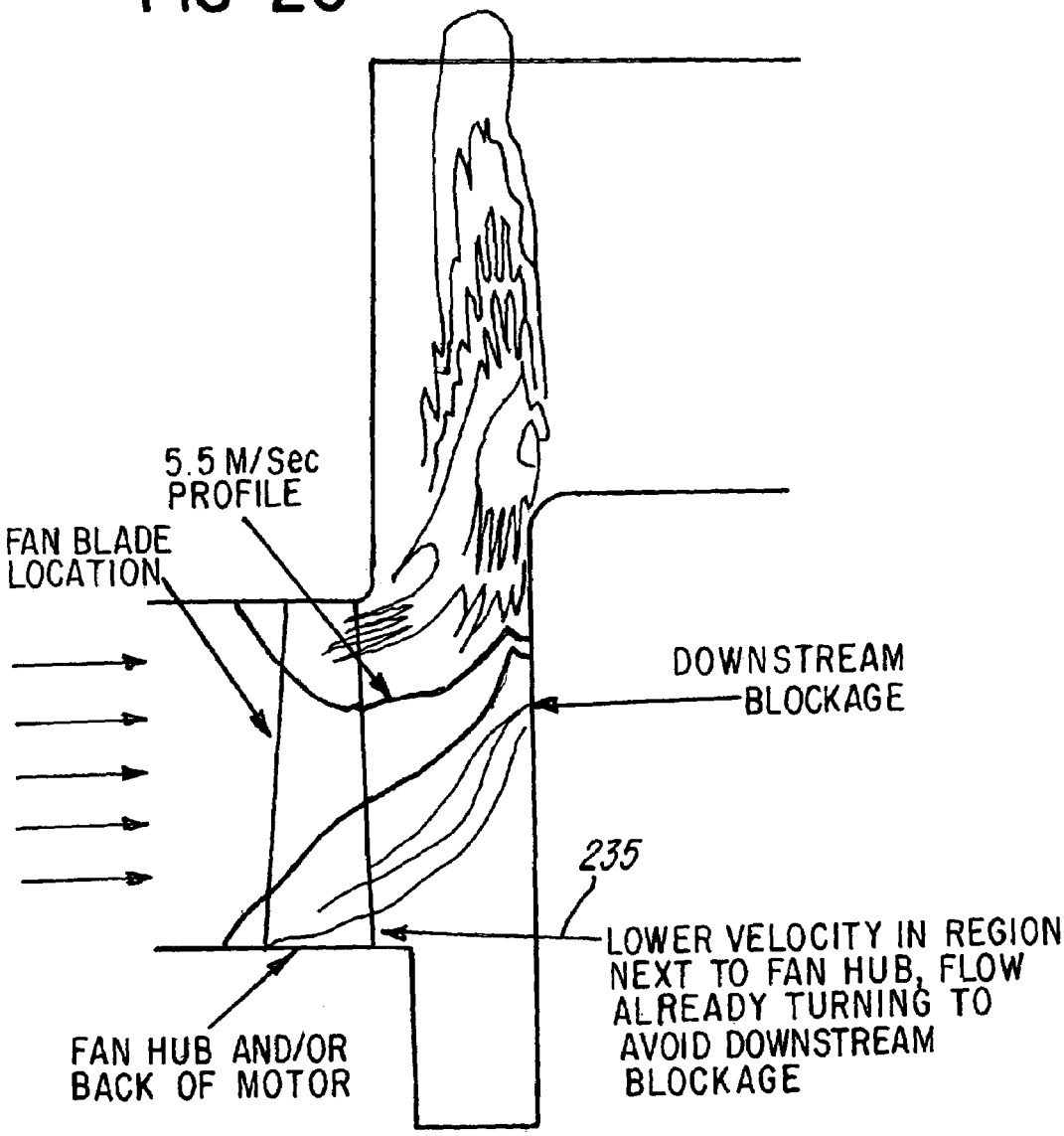
FIG. 20 illustrates a velocity profile of air which encounters a blockage, in the absence of turning vanes.
Figure 21:
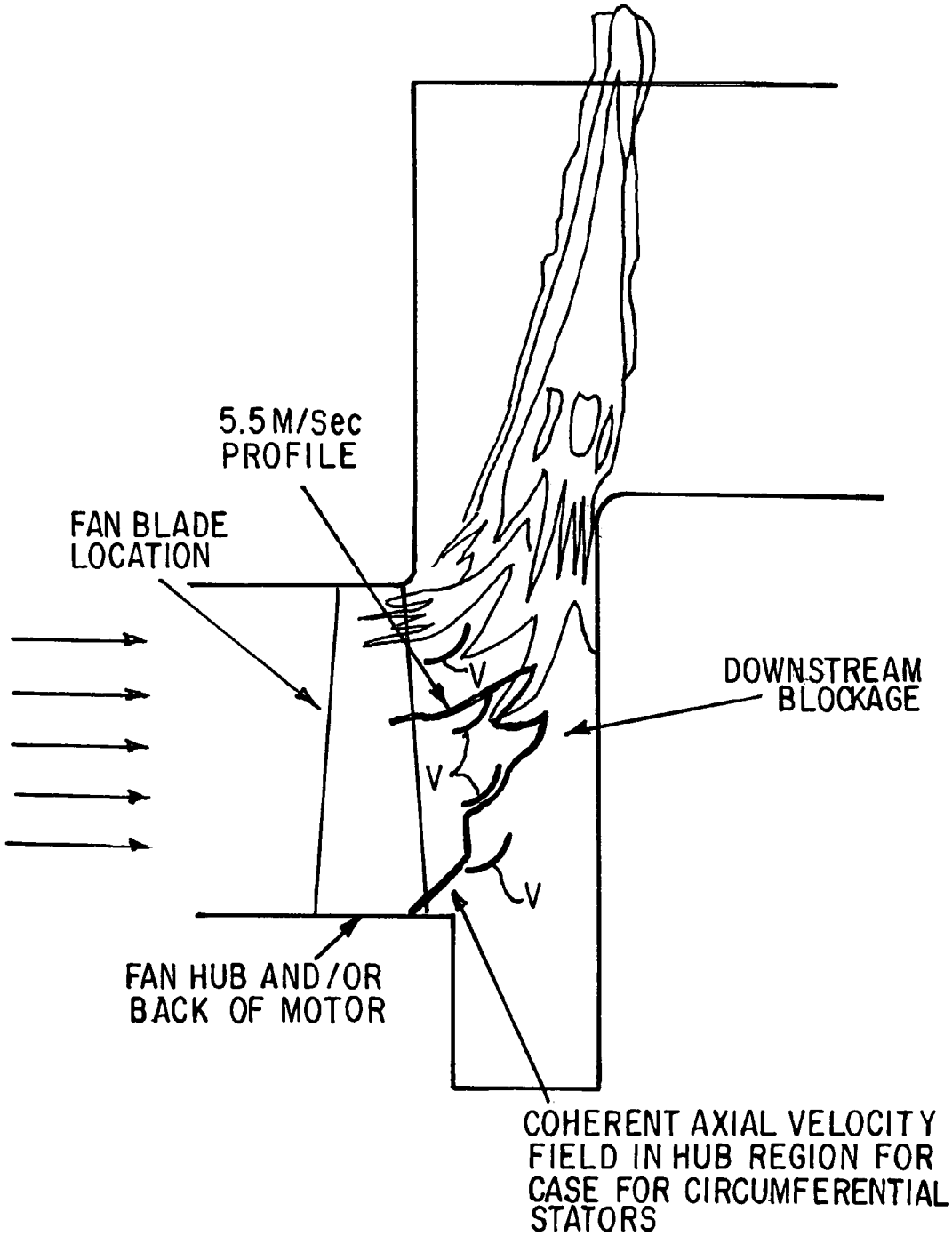
FIG. 21 illustrates a velocity profile of air which encounters a blockage, with turning vanes V present.

FIGS. 20 and 21 are simulations illustrating how the invention mitigates the loss in efficiency caused by the obstacle. In FIG. 20, with no vanes present, the 5.5 meter-per-second profile line 230 is indicated. Arrow 235 points to a region where this velocity has been lost.

In contrast, in FIG. 21, with vanes V present, the velocity in that region is not reduced so greatly. Flow through the fan is maintained more closely to the optimal value.

2. The vanes in cross section can assume airfoil shapes. These shapes can be different at different circumferential locations around the fan.

Figure 22:
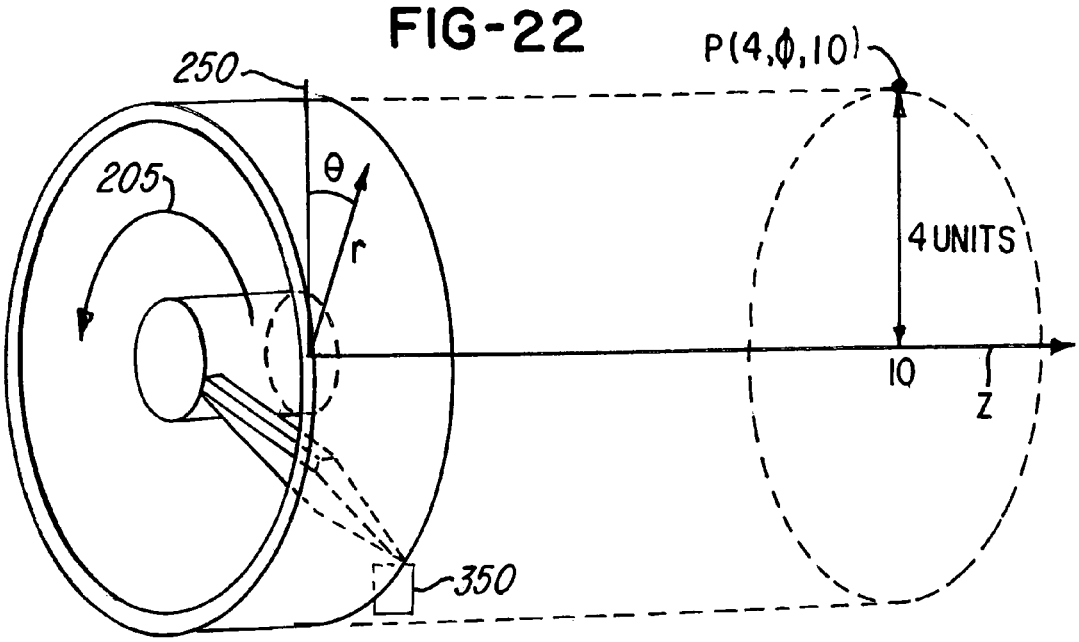
FIG. 22 illustrates a standard cylindrical coordinate system.

FIG. 22 illustrates the fan 200, together with a polar coordinate system superimposed thereon. A z-axis is shown. The radial coordinate, r, is the distance from the z-axis. The angle theta is measured from a reference line 250. Point P, for example, has the coordinates (r, theta, z) of (4, 0, 10).

Figure 23:
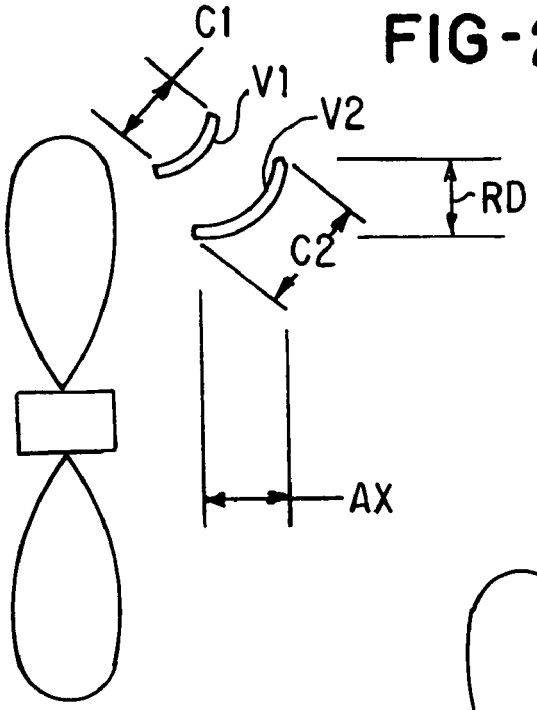
FIGS. 23, 24, and 26 illustrate different forms of the invention.

In general, the shapes of the vanes can be different at different coordinates. For example, in FIG. 23, vane V1 has a chord length C1, while vane V2 has a chord length C2. Different vanes can also have different axial lengths AX or different radial depths RD.

Figure 24:
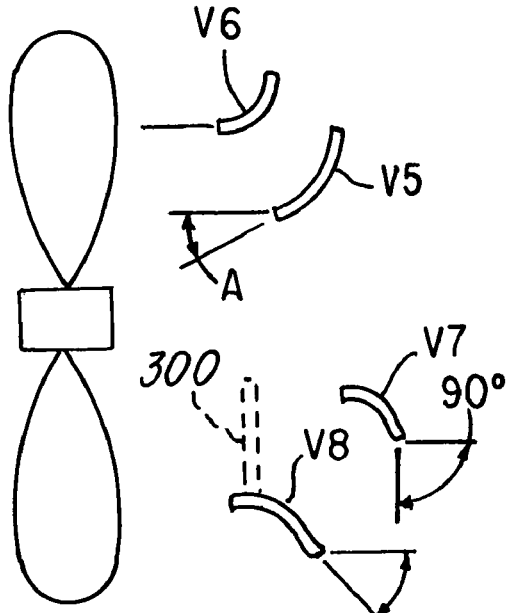

In FIG. 24, vane V5 has an inlet angle A. Vane V6 has a different inlet angle of zero. Vane V7 has an exit angle of ninety degrees. Vane V8 has a different exit angle A2.

Figure 25:
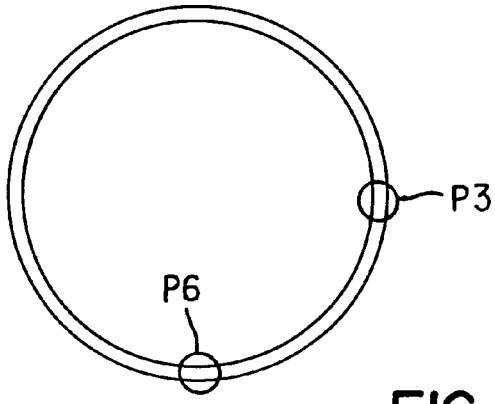
FIG. 25 illustrates two locations P3 and P6, at the 3 o'clock and 6 o'clock positions, respectively.

In one embodiment, the inlet angles, or exit angles, or both, can be similar at similar angles theta, but at different angles theta, they can differ. For example, in FIG. 25, the angles in question can be similar at the 3 o'clock position P3. The angles in question can also be similar at the 6 o'clock position P6, but the former can be different from the latter.

In addition, the similar angles can span a range of positions. For example, the angles in question can be similar from 3 o'clock to 6 o'clock.

Figure 26:
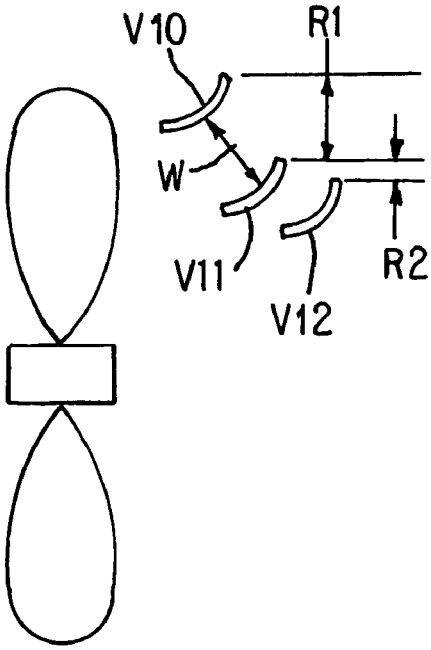

In FIG. 26, three vanes V are shown. The radial distance R1 between adjacent vanes V10 and V11 is different from the radial distance R2 between adjacent vanes V11 and V12.

In a related type of difference, the channel width W between different pairs of vanes is different: different pairs define different channel widths. The channel width W need not be constant. Thus, an average width can be considered, or the minimum or maximum width.

Similarly, an annulus can be defined in the exhaust of the fan. An annulus is a band between two circles of different diameter. For example, the rings of Saturn form an annulus. In one form of the invention, vanes can be present in all or part of an annulus of given inner diameter, but vanes may be absent from other annuli.

Figure 27:
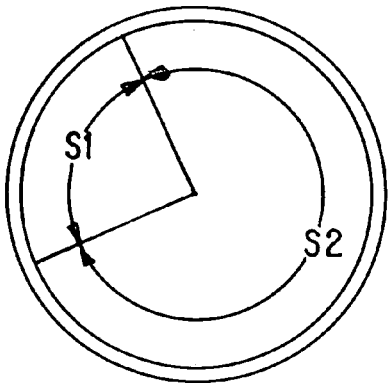
FIG. 27 illustrates two sectors S1 and S2 in a fan.
Figure 28:
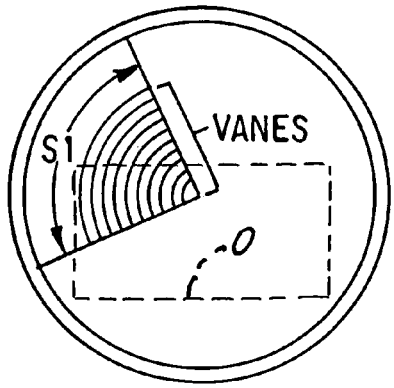
FIG. 28 illustrates vanes occupying part of sector S1.

In FIG. 27, vanes can be present in one sector S1, but absent from another sector S2. In FIG. 28, vanes can be partially present in sector S1, as indicated by the hatching, which indicates the presence of vanes.

Therefore, in general, the airfoil shape of the vanes can be different, at different coordinates (r, theta, z). The difference includes the absence of vanes entirely at certain coordinates. The parameters of airfoil shape, such as chord length, thickness, inlet angle, and exit angle, are defined in the art of aerodynamics. As stated, these parameters can vary over the (r, theta, z) space.

Also, the vanes in the sector which covers the obstacle can be designed differently from vanes in other sectors. For example, in FIG. 28, the obstacle O is represented. Sector S1 covers the obstacle.

3. The vanes can be ring-shaped, with the larger-diameter rings closer to the fan, and the smaller-diameter rings farther from the fan.

4. In one embodiment, radial struts generically indicated by dashed block 300 in FIG. 24 support the vanes.

In many types of fans, such radial struts are shaped to re-direct exhaust air generated by the fan. For example, in FIG. 22, because of the rotation indicated by arrow 205, the airstream generated by the fan will have a velocity component in the tangential direction. The radial struts are shaped to re-direct this tangential air into the axial direction, that is, parallel with the z-axis.

In one form of the invention, this re-direction does not occur, is not desired, and the radial struts are not designed to perform this re-direction.

It is recognized that any time an object is placed in a flow stream, some re-direction will occur. For example, if a flow stream is moving East, and encounters an object, part of the flow stream will flow North, part South, and part upward.

Similarly, if a flow stream generated by a fan encounters a radial strut, part of the flow stream will flow slightly tangentially, to avoid the strut.

Nevertheless, under the form of the invention in question, the struts are not designed to enhance or decrease this minimal amount of tangential flow. Stated another way, the impact on tangential flow is sought to be minimal, and the radial struts designed accordingly.

5. The fan-vane system is designed to be mounted within an engine compartment of a vehicle. Block 350 in FIG. 22 represents a mounting means. For example, the mounting means can take the form of three flanges, each having a bolt hole, the bolt holes defining a triangle. With such three-point mounting, flexing of the vehicle does not impart torsion to the fan.

That is, with four-point mounting, the four points define a quadrilateral, such as a rectangle. Assume that the rectangle is vertical, facing south, and the two lower corners are anchored. If the left upper corner moves north, and the right upper corner moves south, then torsion is applied to the rectangle.

Such torsion does not occur in three-point mounting.

Numerous substitutions and modifications can be undertaken without departing from the true spirit and scope of the invention. What is desired to be secured by Letters Patent is the invention as defined in the following claims.

What is claimed is:

1. An apparatus comprising:

a) a cooling fan which:

i) requires a torque T1 to produce a flow F1 in the absence of a predetermined downstream obstruction;

ii) requires a torque T2, higher than T1, to produce the flow F1 in the presence of the downstream obstruction; and b) means for reducing the required torque below T2, to produce the flow F1 in the presence of the downstream obstruction;

wherein said means comprises stators which divert axially flowing air into radially flowing air, and the radially flowing air grazes the obstruction.

2. An apparatus according to claim 1, wherein said means comprises a plurality of stators which divert airflow away from the obstruction.

3. An apparatus comprising:

a) a cooling fan which:

i) requires a torque T1 to produce a pressure rise P1 across the fan disc in the absence of a predetermined downstream obstruction;

ii) requires a torque T2, higher than T1, to produce the pressure rise P1 in the presence of the downstream obstruction; and b) means for reducing the required torque below T2, to produce the pressure rise P1 in the presence of the downstream obstruction;

wherein the means comprises stators which divert axially flowing air into radially flowing air, and the radially flowing air grazes the obstruction.

4. The apparatus according to claim 3, wherein the means comprises a plurality of stators which divert airflow away from the obstruction.

5. An apparatus for use in a vehicle powered by a heat-producing engine; said apparatus comprising:

a) a fan having an axis and which;

i) cools an upstream heat exchanger which cools coolant used by the engine;

ii) produces an exhaust stream toward an obstacle in the exhaust stream which creates an unfavorable angle of attack within the fan; and b) diverter means which diverts exhaust around the obstacle, to thereby improve the angle of attack within the fan;

wherein the diverter means comprises vanes which add or increase a velocity component to the exhaust which is radially outward from said axis.

6. The apparatus according to claim 5, wherein the vanes have leading edges having tangents which are substantially parallel with said axis.

7. An apparatus according to claim 6, wherein the vanes have trailing edges having tangents which diverge from the axis.

8. The apparatus according to claim 6, wherein the vanes have trailing edges having tangents substantially aligned radial to said axis.

9. The apparatus according to claim 5, wherein said diverter means improves fan efficiency, compared to an apparatus wherein said diverter means is absent.

10. The apparatus according to claim 5, wherein said diverter means occupies a sector of the exhaust and no diverter means is present in another sector of the exhaust.

11. The apparatus according to claim 5, wherein said diverter means comprises a plurality of vanes which are curved in cross section and direct air from a first direction generally parallel to said axis to a second, generally radial direction.

12. The apparatus according to claim 5, wherein said diverter means is present in an annulus of a sector, and not present elsewhere in the exhaust.

13. The apparatus according to claim 5, wherein the diverter means is present in a radially inner part of a sector, not present in a radially outer part of the sector, and not present elsewhere in the exhaust.

14. The apparatus according to claim 5, wherein the diverter means is present in a radially outer part of a sector, not present in a radially inner part of the sector, and not present elsewhere in the exhaust.

* * * * *